US008153075B2

(12) United States Patent
Nagamori et al.

(10) Patent No.: US 8,153,075 B2
(45) Date of Patent: Apr. 10, 2012

(54) GAS HYDRATE PRODUCTION APPARATUS

(75) Inventors: Shigeru Nagamori, Ichihara (JP); Tetsuro Murayama, Ichihara (JP); Hidenori Moriya, Ichihara (JP); Takashi Arai, Ichihara (JP); Nobutaka Oya, Tokyo (JP)

(73) Assignee: Mitsui Engineering & Shipbuilding Co., Ltd., Tokyo (JP)

( * ) Notice: Subject to any disclaimer, the term of this patent is extended or adjusted under 35 U.S.C. 154(b) by 86 days.

(21) Appl. No.: 12/733,950

(22) PCT Filed: Oct. 3, 2007

(86) PCT No.: PCT/JP2007/069395

§ 371 (c)(1),
(2), (4) Date: Mar. 31, 2010

(87) PCT Pub. No.: WO2009/044467

PCT Pub. Date: Apr. 9, 2009

(65) Prior Publication Data

US 2010/0247405 A1 Sep. 30, 2010

(51) Int. Cl.
*F28D 7/00* (2006.01)

(52) U.S. Cl. ..... 422/201; 62/45.1

(58) Field of Classification Search ..... 422/201; 62/45.1

See application file for complete search history.

(56) References Cited

U.S. PATENT DOCUMENTS

| | | | | |
|---|---|---|---|---|
| 6,703,534 | B2 * | 3/2004 | Waycuilis et al. | 585/15 |
| 2005/0059846 | A1 * | 3/2005 | Kohda et al. | 585/15 |
| 2005/0107648 | A1 * | 5/2005 | Kimura et al. | 585/15 |
| 2008/0023175 | A1 * | 1/2008 | Lehr et al. | 165/61 |

FOREIGN PATENT DOCUMENTS

| | | | |
|---|---|---|---|
| JP | 2002-038171 | A | 2/2002 |
| JP | 2002-356685 | A | 12/2002 |
| JP | 2003-055676 | A | 2/2003 |
| JP | 2003-080056 | A | 3/2003 |
| JP | 2003-252804 | A | 9/2003 |
| JP | 2004-155747 | A | 6/2004 |
| JP | 2004-156000 | A | 6/2004 |
| JP | 2006-233143 | A | 9/2006 |
| JP | 2007-269950 | A | 10/2007 |

* cited by examiner

*Primary Examiner* — Walter D Griffin
*Assistant Examiner* — Huy-Tram Nguyen
(74) *Attorney, Agent, or Firm* — Jacobson Holman PLLC

(57) ABSTRACT

The invention provides a gas hydrate production apparatus which can eliminate the need for an agitator in a generator, and at the same time, can make constant the percentage of gas hydration of the product. A shell-and-tube-type generator 2 is provided downstream of an ejector-type mixer 1 that stirs and mixes a raw-material gas g and a raw-material water w. In addition, partition walls 41 to 43 each causing a gas hydrate slurry to turn around are provided in each of end plates 37 and 38 placed respectively in the front and rear ends of the generator 2. Moreover, a dehydrator 3 including a cone-shaped filter 48 is provided downstream of the generator 2, and a drainage pipe 11 is provided to the dehydrator 3. Further, a flow regulating valve 12 is provided to the drainage pipe 11.

5 Claims, 6 Drawing Sheets

(a)

(b)

GAS HYDRATE PRODUCTION APPARATUS

This is a national stage of PCT/JP07/069395 filed Oct. 3, 2007 and published in Japanese, hereby incorporated by reference.

TECHNICAL FIELD

The present invention relates to a gas hydrate production apparatus that produces a gas hydrate by causing a raw-material gas, such as a natural gas, to react with water.

BACKGROUND ART

A gas hydrate is ice-like solid crystals formed of water molecules and gas molecules, and is a generic term referring to clathrate hydrates (hydrates) in each of which each gas molecule is included inside a cage constructed of water molecules with a three-dimensional structure. The gas hydrate has been actively studied and developed as transportation and storage means for natural gases because the gas hydrate contains a natural gas in an amount as large as approximately 165 $Nm^3$ per 1 $m^3$ of the gas hydrate.

As apparatuses for producing gas hydrates, there have conventionally been the following systems: a bubbling system (see, for example, Japanese patent application Kokai publication No. 2003-80056) in which a raw-material gas is blown into a raw-material water in a generator; a spray system (see, for example, Japanese patent application Kokai publication No. 2002-38171) in which a raw-material water is sprayed into a generator filled with a raw-material gas; a tubular reactor system (see, for example, Japanese patent application Kokai publication No. 2002-356685) using a line mixer and a water-tube-type tubular reactor; and the like.

However, the bubbling system has the following problems and the like because the bubbling system includes: a generator with an agitator; an external cooler that removes a generated heat (called also a reaction heat); a gravity dehydrator (called also a gravity dehydrating tower) in which a gas hydrate slurry, generated by the generator and then introduced thereinto, is dehydrated by utilizing gravity so that an unreacted water is removed therefrom. Specifically, (1) the bubbling system requires the agitator, (2) the bubbling system requires two devices, that is, the generator and the external cooler, (3) the dehydrator is large in size because of the gravity dehydration, and (4) the dehydrator is difficult to control because of the gravity dehydration.

Meanwhile, the spray system has the following problems and the like because water is sprayed from a nozzle into the generator filled with a raw-material gas. Specifically, (1) the speed of producing a gas hydrate is slow, and (2) the cooling of a raw-material gas in the generator with the external cooler is associated with a poor heat transmission.

On the other hand, the tube system has the following problems and the like. Specifically, (1) the tubular reactor is long, and (2) a pressure drop is large because of the long tubular reactor.

DISCLOSURE OF THE INVENTION

Problems to be Solved by the Invention

An object of the present invention is to provide a gas hydrate production apparatus with no need for an agitator in a generator and with a simple structure, as well as with easy control of a dehydrator and with capability of making constant the percentage of gas hydration of the product.

Means for Solving the Problems

A gas hydrate production apparatus according to the invention as recited in claim 1 is characterized by including: an ejector-type mixer that stirs and mixes a raw-material gas and a raw-material water; a shell-and-tube-type generator provided downstream of the ejector-type mixer; partition walls provided in end plates placed respectively in the front and rear ends of the generator, the partition walls each causing a gas hydrate slurry to turn around; a dehydrator provided downstream of the generator, the dehydrator including a cone-shaped filter; a drainage pipe provided to the dehydrator; and a flow regulating valve provided to the drainage pipe.

A gas hydrate production apparatus according to the invention as recited in claim 2 is characterized by including: an ejector-type first mixer that stirs and mixes a raw-material gas and a raw-material water; a shell-and-tube-type first generator provided downstream of the ejector-type first mixer, the first generator intended to generate gas hydrate cores; an ejector-type second mixer provided downstream of the first generator, the second mixer mixing the raw-material gas into a slurry containing the gas hydrate cores, and then stirring and mixing the raw-material gas and the slurry; a second generator provided downstream of the second mixer, the second generator intended to generate a gas hydrate; and a flow regulating valve provided to a pipe through which a part of the gas hydrate slurry generated by the second generator is returned to the second mixer.

The invention as recited in claim 3 is characterized in that, in the gas hydrate production apparatus as recited in claim 2, partition walls are provided in each of end plates placed respectively in the front and rear ends of each of the first and second generators, the partition walls each causing the slurry to turn around.

The invention as recited in claim 4 is characterized in that, in the gas hydrate production apparatus as recited in claim 1 or 3, corner portions are provided among joint portions of each end plate and the corresponding partition walls, the corner portions each having a curved wettable surface.

The invention as recited in claim 5 is characterized in that, in the gas hydrate production apparatus as recited in claim 1 or 2, first collision bodies and second collision bodies are provided alternately in a narrowly constricted body portion of each ejector type mixer, the first collision bodies each being a plate-shaped base plate provided with triangular or trapezoidal penetrating portions radially formed therein, the second collision bodies each being a plate-shaped base plate provided with a stellate penetrating portion formed therein.

The invention as recited in claim 6 is characterized in that, in the gas hydrate production apparatus as recited in claim 1, a part of the gas hydrate slurry generated by the generator is returned and recirculated to the generator.

The invention as recited in claim 7 is characterized in that, in the gas hydrate production apparatus as recited in claim 2, a part of the gas hydrate slurry generated by the first generator is returned and recirculated to the first generator.

Effects of the Invention

As described above, in the invention according to claim 1, the raw-material gas and the raw-material water are stirred and mixed by the ejector-type mixer. Accordingly, the invention eliminates the need for an agitator in a generator, a motor for driving such agitator, and the like. As a result, the structure is simplified and no electric power for driving a motor is required.

In addition, in the invention, the shell-and-tube-type generator is provided downstream of the ejector-type mixer and the partition walls each causing the gas hydrate slurry to turn around are provided in the end plates placed respectively in the front and rear ends of the generator. Accordingly, the invention makes the generator compact as compared to the conventional tubular reactor system including a plurality of bent tubes, and thus makes it possible to suppress a pressure drop in the generator. Moreover, since the generator is of the shell-and-tube type, the generator is capable of efficiently removing a reaction heat generated during the generation of a gas hydrate, and therefore, is capable of efficiently generating a gas hydrate.

Further, in the invention, the dehydrator including the cone-shaped filter is provided downstream of the generator, and the flow regulating valve is provided to the drainage pipe of the dehydrator. Accordingly, the invention facilitates the control on the dehydrator, and thus makes it possible to control the percentage of gas hydration (hereinafter, called an NGH percentage) of a gas hydrate as a product.

The percentage of gas hydration herein means a weight ratio of a hydrate of theoretical values to the weight of a sample.

[Mathematical Formula 1]

$$H = 100 \times \frac{(W_1 - W_2) \times \{1 + N \times Mw/Mg\}}{W_1}$$

H: Percentage of Gas Hydration (%)
$W_1$: Weight of Sample (g)
$W_2$: Weight of Water Constituting Hydrate (g)
Mw: Molecular Weight of Water
Wg: Molecular Weight of Gas
N: Hydration Number In the invention according to claim 2, as described above, the second generator intended to generate a gas hydrate is provided downstream of the shell-and-tube-type first generator intended to generate gas hydrate cores, and further, the flow regulating valve is provided to the pipe through which a part of the gas hydrate slurry generated by the second generator is returned to the second mixer. Accordingly, the invention makes it possible not only to increase the particle size of the gas hydrate but also to control the NGH percentage.

In addition, the invention eliminates, in the same manner as that of the invention according to claim 1, the need for an agitator in a generator, a motor for driving such agitator, and the like. Further, the invention makes the generator compact as compared to the conventional tubular reactor system including a plurality of bent tubes, and thus makes it possible to suppress a pressure drop in the generator. Moreover, since the generator is of the shell-and-tube type, the generator exerts the effect of efficiently removing a reaction heat, and the like.

In the invention according to claim 3, the partition walls each causing the slurry to turn around are provided in the end plates placed respectively in the front and rear ends of each of the first and second generators. Accordingly, the invention makes it possible to elongate the gas hydrate generating region with no increase in pressure drops in the first and second generators, and accordingly, makes it possible to promote the generation of gas hydrate cores and the growth of particles of the gas hydrate.

In the invention according to claim 4, the corner portions each having the curved wettable surface are provided among the joint portions of each end plate and the corresponding partition walls. Accordingly, the invention makes it possible to make uniform the flow rate of the gas hydrate slurry in each end plate.

In the invention according to claim 5, the first collision bodies and the second collision bodies are alternately provided in the narrowly constricted body portion of the ejector-type mixer. Here, each first collision body is a plate-shaped base plate provided with triangular or trapezoidal penetrating portions formed therein, and each second collision body is a plate-shaped base plate provided with a stellate penetrating portion formed therein. Accordingly, the raw-material water is intensively stirred by the first and second collision bodies, and the raw-material gas is involved into the raw-material water and crushed into fine bubbles therein, so that the raw-material water and the raw-material gas are mixed with each other. In this way, the area of contact between the raw-material gas and the raw-material water is increased. As a result, the raw-material gas is efficiently dissolved into the raw-material water.

Consider the case where a part of the gas hydrate slurry generated by the generator is returned and recirculated to the generator, as in the invention according to claim 6. In this case, since the hydrate cores are present in the gas hydrate slurry, the gas hydrate is generated at the operating temperature with no need for a supercooling process.

On the other hand, in the case where no recirculation is performed, a mixture of the water and gas discharged from the mixer is caused to enter a shell-and-tube heat exchanger and is thus cooled therein. However, the hydrate is not generated until the temperature reaches a range where the degree of supercooling has a certain value (4 to 8° C.). In addition, once the degree of supercooling reaches the value, the hydrate is rapidly generated, and the temperature is decreased to the temperature of the steady operation. If the hydrate is rapidly generated in this way, the inside of the tubes is sometimes blocked by the hydrate. Moreover, since the amount of heat transmission is decreased in the supercooling section, the apparatus has to be increased in size.

The degree of supercooling is a difference between a generation temperature for the hydrate and an equilibrium temperature between generation and decomposition at the generation pressure for the hydrate, and is expressed by the following formula.

$$\Delta T = Te - Tf$$ [Mathematical Formula 2]

Here,
ΔT: Degree of Supercooling [K];
Te: Equilibrium Temperature at Generation Pressure [K];
Tf: Generation Temperature [K].

Also in the case where a part of the gas hydrate slurry generated by the first generator is returned and recirculated to the first generator, as in the invention according to claim 7, the same effects as described above are obtained.

Figure 4:
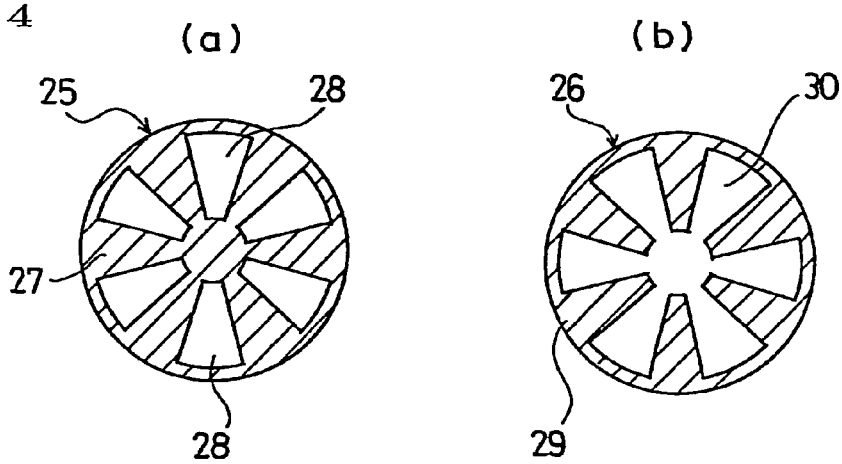

Part (a) of FIG. 4 is a front view of a first collision body, and Part (b) of FIG. 4 is a front view of a second collision body.

Figure 5:
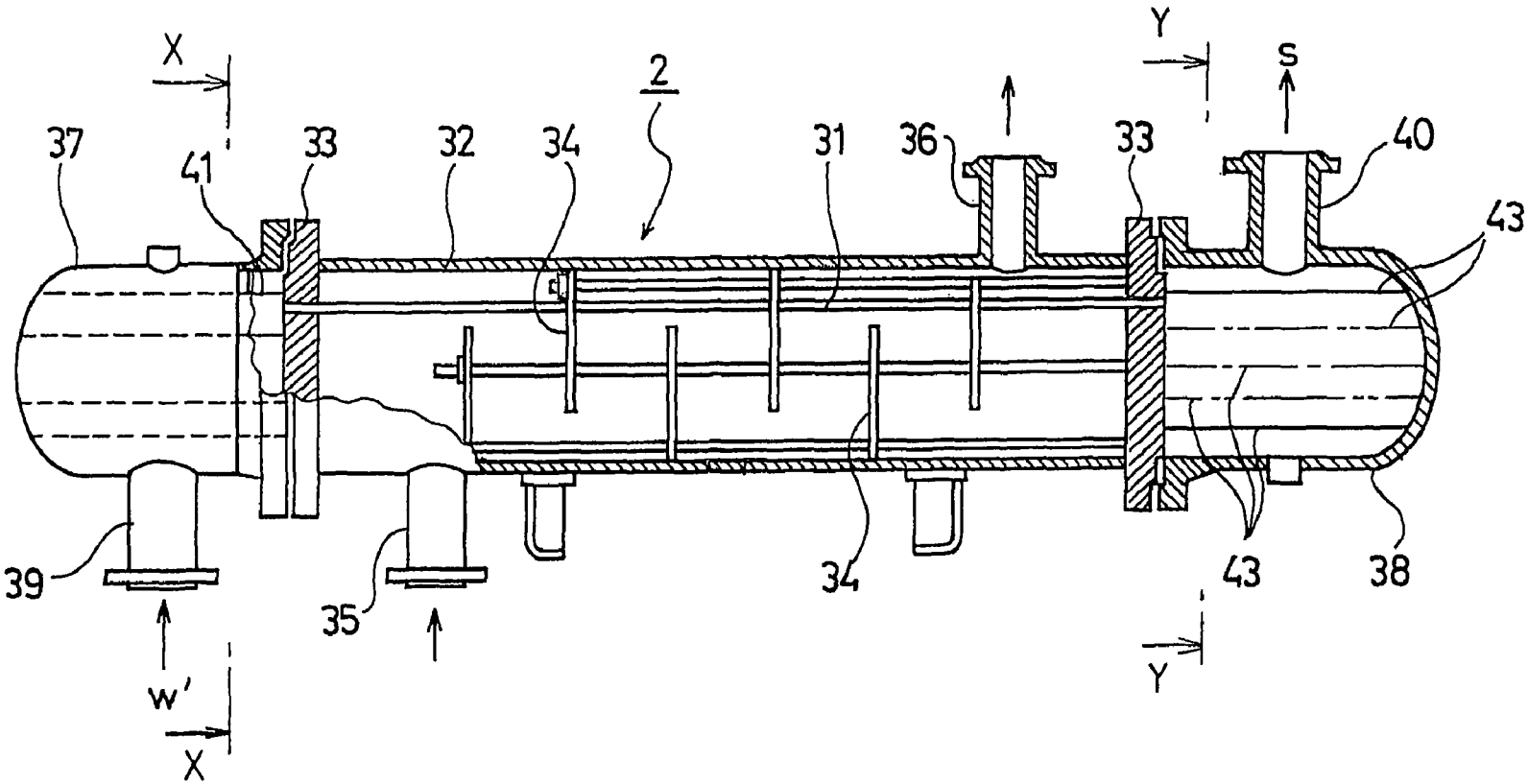

FIG. 5 is a partially cross-sectional side view of a generator.

Figure 6:
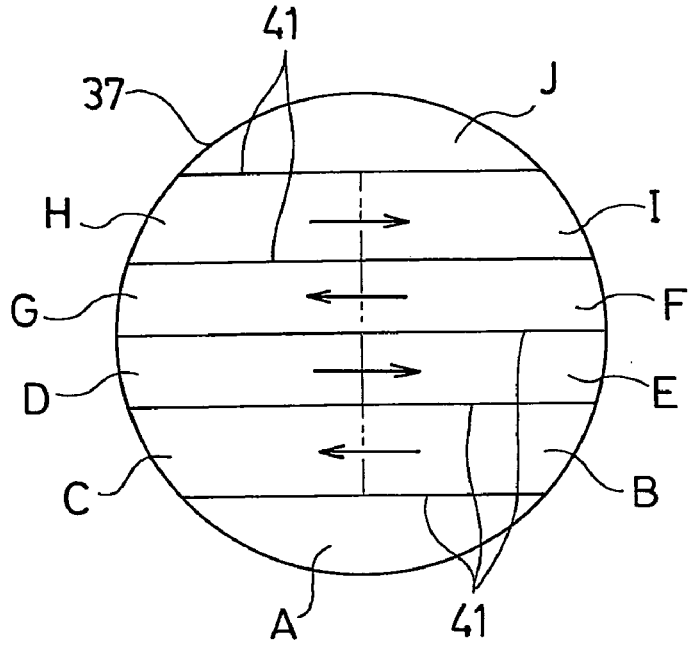
Figure 6:
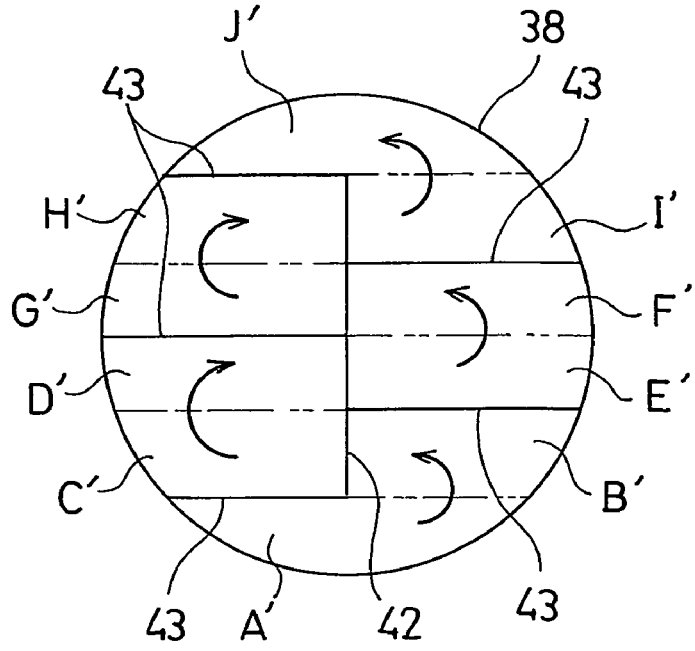

Part (a) of FIG. 6 is a cross-sectional view taken along a line X-X in FIG. 5, and Part (b) of FIG. 6 is a cross-sectional view taken along a line Y-Y in FIG. 5.

Figure 7:
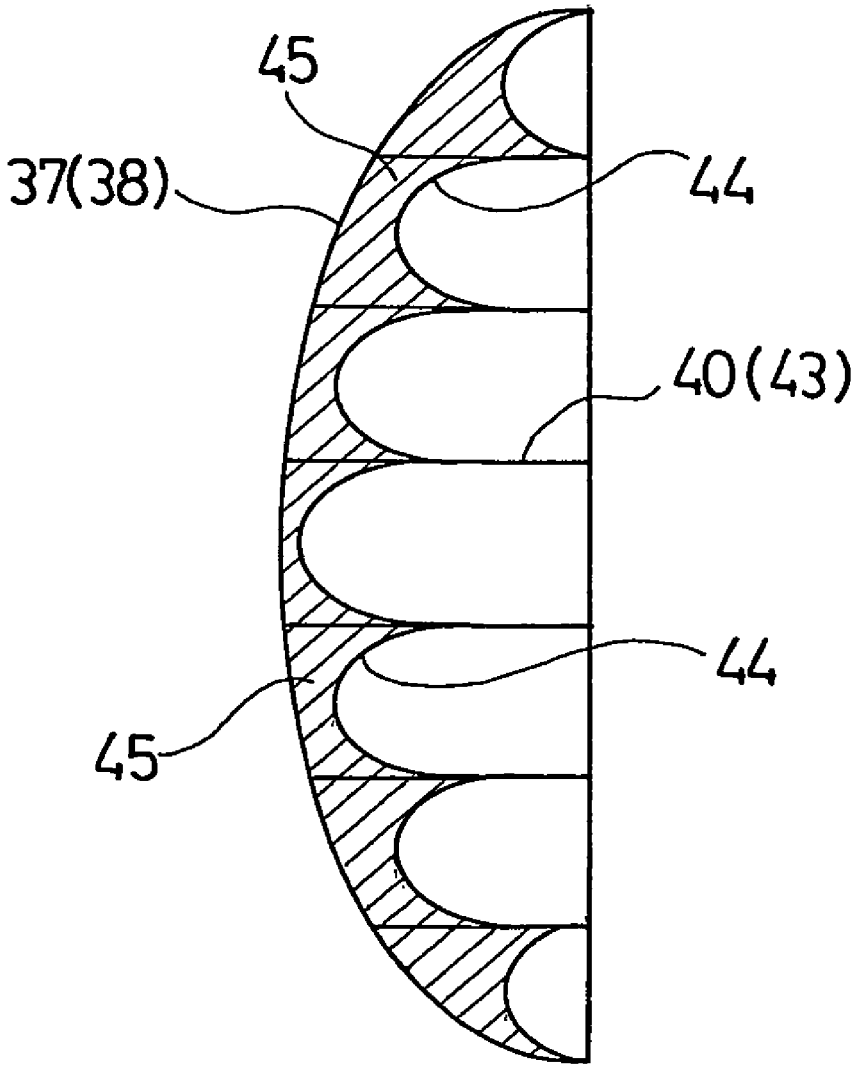

FIG. 7 is a cross-sectional view of an end plate.

Figure 8:
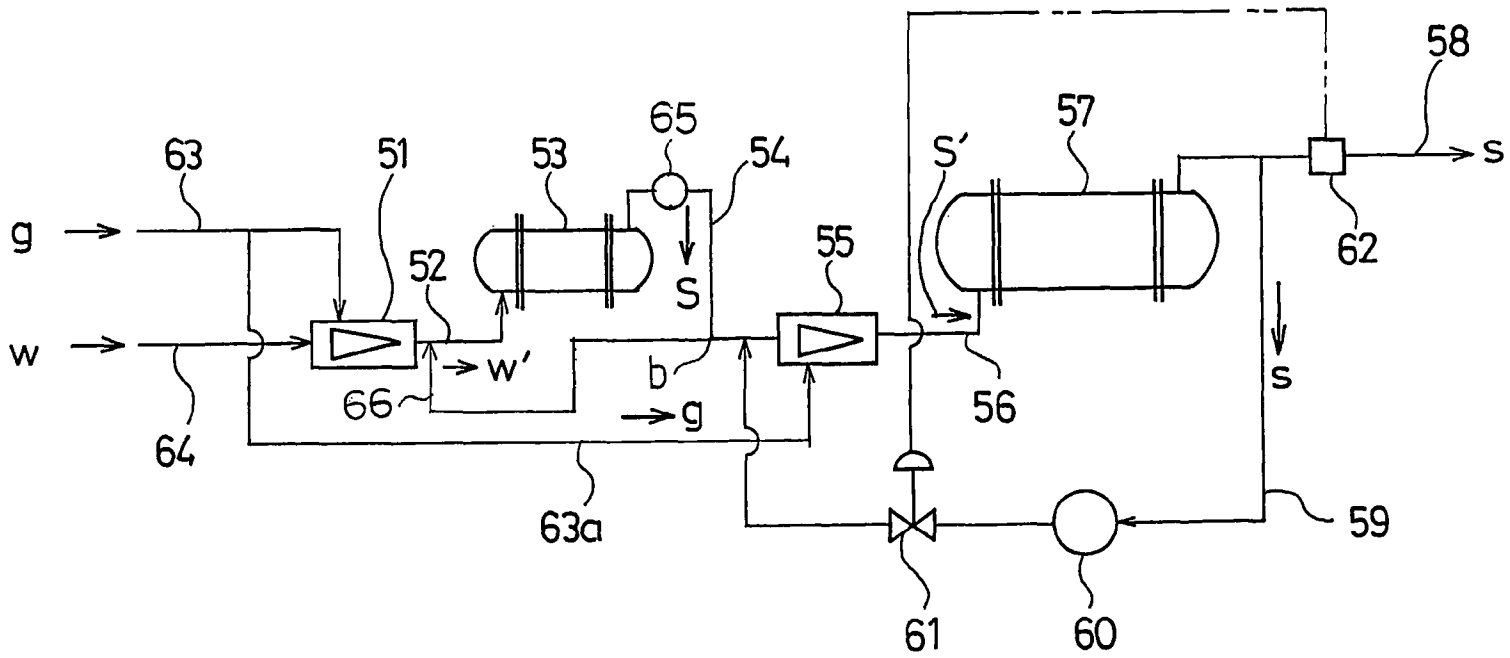

FIG. 8 is a schematic configurational diagram of another embodiment of the gas hydrate production apparatus according to the present invention.

| EXPLANATION OF REFERENCE SIGNS | |
|---|---|
| g | raw-material gas |
| s | gas hydrate slurry |
| w | raw-material water |
| 1 | ejector-type mixer |
| 2 | shell-and-tube-type generator |
| 3 | dehydrator |
| 11 | drainage pipe |
| 12 | flow regulating valve |
| 37, 38 | end plate |
| 41, 42, 43 | partition wall |
| 48 | filter |

BEST MODES FOR CARRYING OUT THE INVENTION

First, a first embodiment will be described, and then, a second embodiment will be described.

(1) First Embodiment

Figure 1:
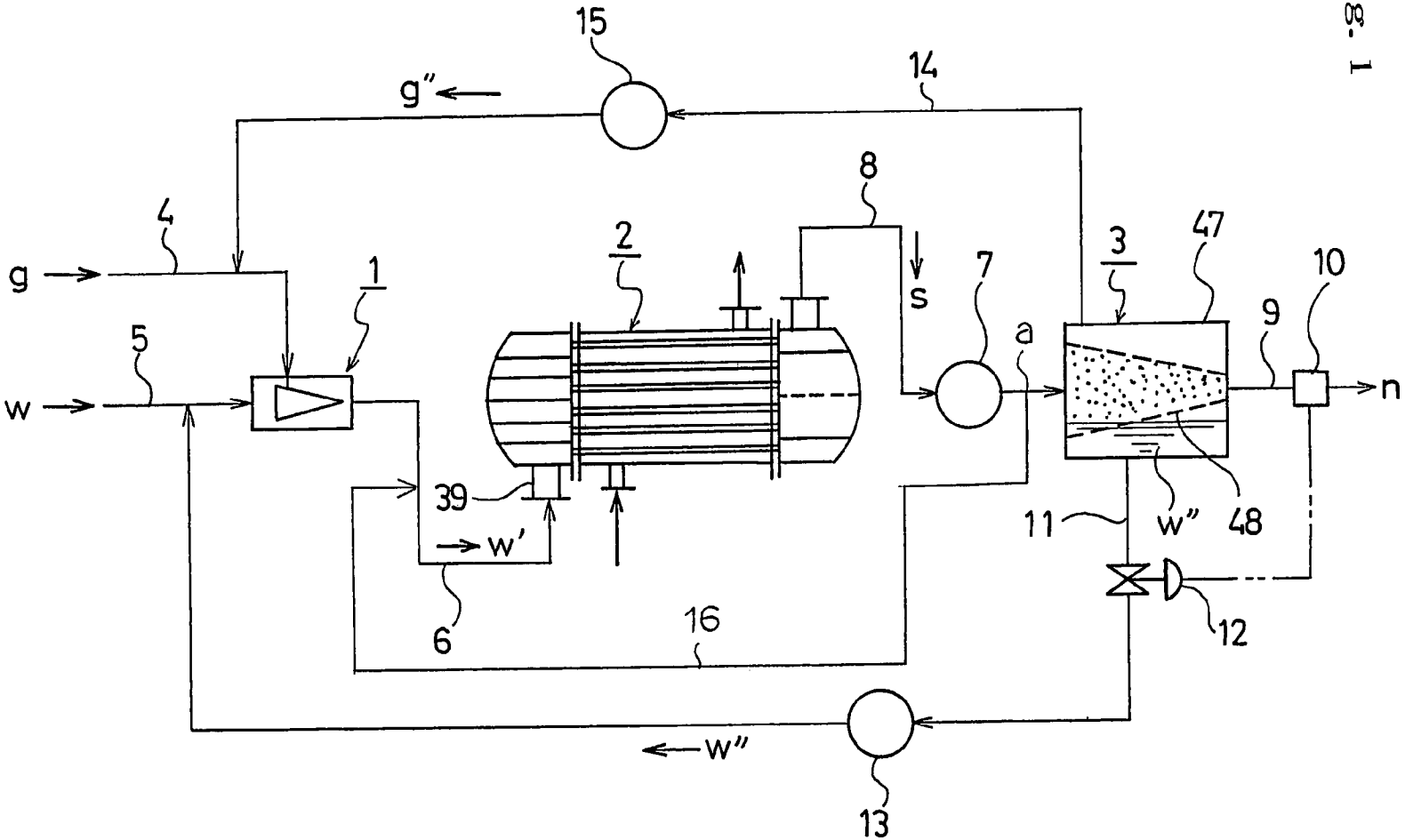
FIG. 1 is a schematic configurational diagram of a gas hydrate production apparatus according to the present invention.

A gas hydrate production apparatus of the present invention includes, as illustrated in FIG. 1, an ejector-type mixer 1, a shell-and-tube-type gas hydrate generator 2, and a dehydrator 3. A raw-material gas supply pipe 4 and a raw-material water supply pipe 5 are connected to the mixer 1. Further, the mixer 1 and the gas hydrate generator 2 are connected to each other by a pipe 6. The gas hydrate generator 2 and the dehydrator 3 are connected to each other by a slurry supply pipe 8 including a slurry pump 7.

The slurry supply pipe 8 is branched at a branching point a located between the slurry pump 7 and the dehydrator 3, and is thus configured so that apart of the slurry is injected into the pipe 6 through a branch pipe 16. The amount of slurry to be circulated may be approximately 0 to 10%. In addition, an NGH percentage meter 10 is provided to a gas hydrate discharge pipe 9 that is provided at an outlet of the dehydrator 3. Moreover, a flow regulating valve 12 and a pump 13 are provided to a drainage pipe 11 that connects the dehydrator 3 and the raw-material water supply pipe 5. Further, a compressor 15 is provided to an unreacted-gas recovery pipe 14 that connects the dehydrator 3 and the raw-material gas supply pipe 4.

Here, the flow regulating valve 12 is controlled by means of the NGH percentage meter 10. As the NGH percentage meter, a mixing-ratio measurement system for a mixed-phase fluid (see Japanese patent application Kokai publication No. Sho 62-172253) or the like may be employed, for example.

Figure 2:
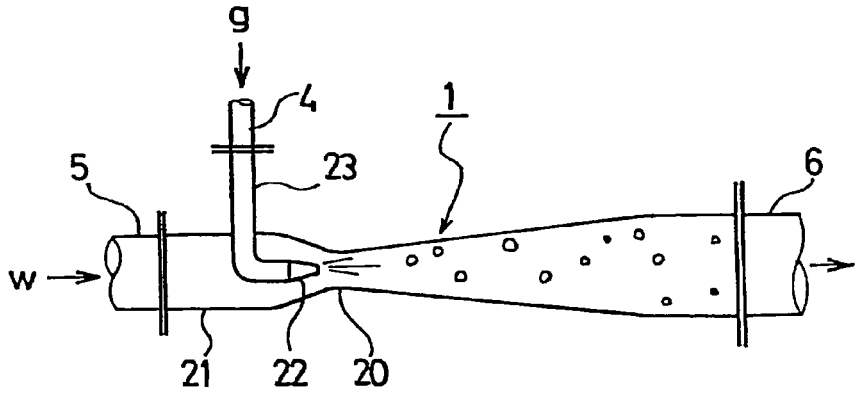
FIG. 2 is a cross-sectional view of a mixer.

As illustrated in FIG. 2, the ejector-type mixer 1 is formed of: a tubular body 21 that has a narrowly constricted body portion 20; and a nozzle 23 that is located upstream of the body portion 20 and has a nozzle tip 22 bent in an L-shape and located at an inlet of the body portion 20. Here, the raw-material water supply pipe 5 is connected to an upstream end of the tubular body 21, the pipe 6 is connected to a downstream end of the tubular body 21, and the raw-material gas supply pipe 4 is connected to the nozzle 23.

Figure 3:
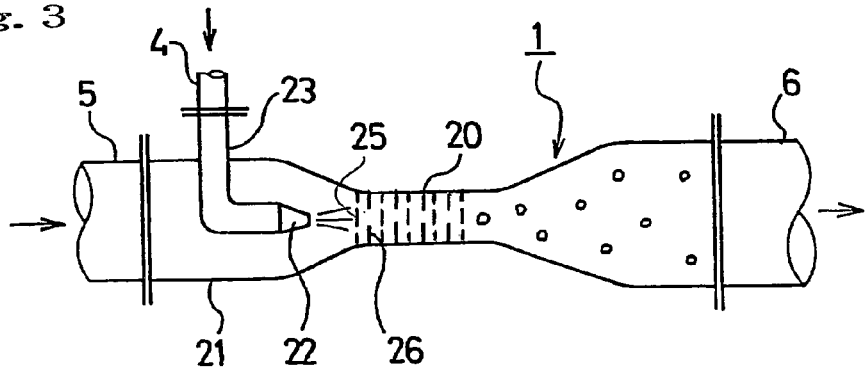
FIG. 3 is a cross-sectional view of a mixer.

Although there is no problem with the ejector-type mixer illustrated in FIG. 2, first collision bodies 25 and second collision bodies 26 may be alternately provided in the narrowly constricted body portion 20 as illustrated in FIG. 3, which make it possible to further promote the mixing of the raw-material gas and the raw-material water. Each of the first collision bodies 25 is, as illustrated in Part (a) of FIG. 4, a circular base plate 27 provided with triangular or trapezoidal penetrating portions 28 radially formed therein. Each of the second collision bodies 26 is, as illustrated in Part (b) of FIG. 4, a circular base plate 29 provided with a stellate penetrating portion 30 formed therein. In this case, each first collision body 25 and each second collision body 26 are arranged in such a manner that one of the first and second collision bodies 25 and 26 is rotated slightly in a clockwise direction or a counterclockwise direction so that the penetrating portions 28 and 30 should not overlap each other.

As illustrated in FIG. 5, the shell-and-tube-type gas hydrate generator 2 includes a body portion 32 incorporating a plurality of tubes 31. The opposite ends of each tube 31 penetrate tube plates 33, 33 that tightly close the opposite ends of the body portion 32, respectively. The body portion 32 includes partition plates 34 provided alternately on a ceiling portion and a bottom portion of the body portion 32, so that a coolant fluid that has flowed thereinto from a coolant inflow portion 35 meanders and moves therein to be discharged from a coolant outflow portion 36.

The gas hydrate generator 2 includes a first end plate 37 in a front end portion (an upstream portion) of the body portion 32 and includes a second end plate 38 in a rear end portion (a downstream portion) of the body portion 32. The first end plate 37 includes a processed-target inflow portion 39 in a bottom portion thereof. The second end plate 38 includes a processed-target outflow portion 40 in an upper portion thereof.

Inside the first endplate 37, as illustrated in Part (a) of FIG. 6, a plurality of (for example, 10) sections A to J are formed by a plurality of (for example, 5) partition walls 41 horizontally provided. In the embodiment, each pair of the sections B and C, the sections D and E, the sections F and G, and the sections H and I, which are each situated on the right and left sides, communicate with each other.

On the other hand, inside the second end plate 38, as illustrated in Part (b) of FIG. 6, a vertical partition wall 42 extending from a section A' to a section J' is provided at the center, and partition walls 43 are provided between the section A' and a section C', between sections D' and G', between a section H' and the section J', between sections B' and E', and between sections F' and I', respectively.

Here, as illustrated in FIG. 7, corner portions 45 each having a curved wettable surface 44 are provided among the joint portions of the first end plate 37 and the partition walls 41 as well as the joint portions of the second end plate 38 and the partition walls 42 and 43 so that no dead zone for water should be formed therein.

The dehydrator 3 is, as illustrated in FIG. 1, formed of a pressure-tight container 47 and a cone-shaped (a conical frustum-shaped) filter 48 provided substantially horizontally in the pressure-tight container 47. The filter 48 has been subjected to mesh processing. In addition, the drainage pipe 11 is connected to a bottom portion of the pressure-tight container 47, while the unreacted-gas recovery pipe 14 is connected to an upper portion of the pressure-tight container 47. It should be noted that, as needed, a cone-shaped screw (not illustrated) may be provided inside the filter 48, thereby increasing the force to thrust the gas hydrate slurry. Moreover, the dehydrator 3 may be one in which the filter 48 is provided in an upright posture.

Next, the operation of the above-described gas hydrate production apparatus will be described.

As illustrated in FIG. 2, a raw-material water w that has been cooled to a predetermined temperature (for example, 4 to 8° C.) is supplied to the tubular body 21 of the mixer 1, and a raw-material gas g that has been pressurized up to a predetermined pressure (for example, 4 to 5.5 MPa) is supplied to the nozzle 23 of the mixer 1. In this event, the flow rate is drastically increased in the narrowly constricted body portion 20 of the tubular body 21. Accordingly, the raw-material gas g is formed into fine bubbles, which are then mixed uniformly with the raw-material water w.

A mixed water w' into which the raw-material gas has been mixed flows through the pipe 6 to be supplied to the processed-target inflow portion 39 of the shell-and-tube-type gas hydrate generator 2, as illustrated in FIG. 1. The mixed water w' thus supplied to the processed-target inflow portion 39 of the shell-and-tube-type gas hydrate generator 2 is, as illustrated in FIG. 5, caused to turn around along each of the partition walls 41 inside the first end plate 37 and the partition walls 42 and 43 inside the second end plate 38, thereby meandering many times in the body portion 32. The mixed water w' is eventually discharged from the processed-target outflow portion 40. While the mixed water w' flows, the raw-material gas g and the raw-material water w react with each other to form a gas hydrate slurry s.

Here, the flow of the mixed water w' in the first end plate 37 and the second end plate 38 will be described. In the first end plate 37, as illustrated in Part (a) of FIG. 6, the mixed water w' flows from the section B to the section C, from the section D to the section E, from the section F to the section G, and from the section H to the section I. In the second end plate 38, as illustrated in Part (b) of FIG. 6, the mixed water w' flows from the section A' to the section B', from the section C' to the section D', from the section E' to the section F', from the section G' to the section H', and from the section I' to the section J'.

The gas hydrate slurry s (having an NGH percentage of 20 to 30%) generated by the gas hydrate generator 2 is, as illustrated in FIG. 1, supplied to the dehydrator 3 by the slurry pump 7. The gas hydrate slurry s supplied to the dehydrator 3 is pressurized and thus dehydrated by the thrust force of the slurry pump 7 because the filter 48 is formed in the cone shape. As a result, the gas hydrate slurry s is formed into a gas hydrate n having an NGH percentage of approximately 40 to 60%.

An unreacted water w" generated through the dehydration by the dehydrator 2 is returned to the raw-material water supply pipe 5 by the pump 13. In this event, the NGH percentage can be controlled by adjusting the flow regulating valve 12 by means of the NGH percentage meter 10 provided to the gas hydrate discharge pipe 9. On the other hand, an unreacted gas g" accumulated in the dehydrator 3 is returned to the raw-material gas supply pipe 4 through the unreacted-gas recovery pipe 14.

Next, a second embodiment will be described.

(2) Second Embodiment

In a gas hydrate production apparatus of this embodiment, as illustrated in FIG. 8, a shell-and-tube-type first generator 53 intended to generate gas hydrate cores is provided downstream of an ejector-type first mixer 51 with a first pipe 52 interposed therebetween, the first mixer 51 stirring and mixing a raw-material gas g and a raw-material water w. Further, an ejector-type second mixer 55 is provided downstream of the first generator 53 with a second pipe 54 interposed therebetween. Moreover, a second generator 57 intended to generate a gas hydrate is provided downstream of the second mixer 55 with a third pipe 56 interposed therebetween.

Furthermore, a gas hydrate slurry discharge pipe 58 provided to the second generator 57 and the second pipe 54 are connected to each other through a gas hydrate slurry return pipe 59. A pump 60 and a flow regulating valve 61 are provided to the gas hydrate slurry return pipe 59. The flow regulating valve 61 is controlled by means of an NGH percentage meter 62 provided to the gas hydrate slurry discharge pipe 58.

Moreover, a raw-material-gas supply pipe 63 and a raw-material-water supply pipe 64 are provided to the first mixer 51. Furthermore, a raw-material-gas supply pipe **63*a* branched from the raw-material-gas supply pipe 63 is provided to the second mixer 55. Note that the structure of each of the first mixer 51 and the second mixer 55 is the same as that of the mixer 1 in the first embodiment, and thus detailed description thereof will be omitted. Also, the structure of each of the first generator 53 and the second generator 57 is the same as that of the generator 2** in the first embodiment, and thus detailed description thereof will be omitted.

Next, the operation of the gas hydrate production apparatus of this embodiment will be described.

As illustrated in FIG. 8, a raw-material water w that has been cooled to a predetermined temperature (for example, 4 to 8° C.) and a raw-material gas g that has been pressurized up to a predetermined pressure (for example, 4 to 5.5 MPa) are supplied to the ejector-type first mixer 51. At this time, the raw-material gas g is formed into fine bubbles, which are then mixed uniformly with the raw-material water w. A mixed water w' into which the raw-material gas g has been mixed flows through the first pipe 52 to be supplied to the shell-and-tube-type first generator 53. The mixed water w' thus supplied to the first generator 53 undergoes reaction to form minute gas hydrate cores while meandering forward and backward inside the shell-and-tube type first generator 53.

A slurry S (having an NGH percentage of 1 to 5%) containing the gas hydrate cores formed in the first generator 53 flows through the second pipe 54 to be supplied to the second mixer 55. The second pipe 548 located between a slurry pump 65 and the second mixer 55 branches at a branching point b, and is thus configured so that a part of the slurry is injected into the first pipe 52 through a branch pipe 66. Here, the amount of the slurry to be circulated may be approximately 0 to 10%.

Since the raw-material gas g is supplied to the second mixer 55 from the raw-material-gas supply pipe **63*a*, the slurry S and the raw-material gas g are stirred and mixed by the second mixer 55. A slurry S' thus supplied with the raw-material gas g flows through the third pipe 56 to be supplied to the shell-and-tube-type second generator 57. The slurry S' supplied to the second generator 57 undergoes reaction to form a gas hydrate slurry s while meandering forward and backward inside the shell-and-tube-type second generator 57** having a cooling temperature set at, for example, 1 to 7° C.

The gas hydrate slurry s thus generated by the second generator 57 is discharged to the next process through the gas hydrate slurry discharge pipe 58. In the meantime, the NGH percentage of the gas hydrate slurry s can be controlled (for example, at 20 to 30%) by controlling the flow regulating valve 61 by means of the NGH percentage meter 62 provided to the gas hydrate slurry discharge pipe 58.

Moreover, since a part of the gas hydrate slurry s generated by the second generator 57 is returned to the upstream of the second mixer 55 through the gas hydrate slurry return pipe 59, the crystallization of the gas hydrate is promoted, so that the particles of the gas hydrate can be increased in size.

What is claimed is:

1. A gas hydrate production apparatus comprising:

an ejector-type mixer that stirs and mixes a raw-material gas and a raw-material water;

a shell-and-tube-type generator provided downstream of the ejector-type mixer;

partition walls provided in end plates placed respectively in the front and rear ends of the generator, the partition walls each causing a gas hydrate slurry to turn around;

a dehydrator provided downstream of the generator, the dehydrator including a cone-shaped filter;

a drainage pipe provided to the dehydrator; and a flow regulating valve provided to the drainage pipe.

2. The gas hydrate production apparatus according to claim 1, characterized in that corner portions are provided among joint portions of each end plate and the corresponding partition walls, the corner portions each having a curved wettable surface.

3. The gas hydrate production apparatus according to claim 1, characterized in that first collision bodies and second collision bodies are provided alternately in a narrowly constricted body portion of each ejector type mixer, the first collision bodies each being a plate-shaped base plate provided with triangular or trapezoidal penetrating portions radially formed therein, the second collision bodies each being a plate-shaped base plate provided with a stellate penetrating portion formed therein.

4. The gas hydrate production apparatus according to claim 1, characterized in that a part of the gas hydrate slurry generated by the generator is returned and recirculated to the generator.

5. A gas hydrate production apparatus comprising:

an ejector-type first mixer that stirs and mixes a raw-material gas and a raw-material water;

a shell-and-tube-type first generator provided downstream of the ejector-type first mixer, the first generator intended to generate gas hydrate cores;

an ejector-type second mixer provided downstream of the first generator, the second mixer mixing the raw-material gas into a slurry containing the gas hydrate cores, and then stirring and mixing the raw-material gas and the slurry;

a second generator provided downstream of the second mixer, the second generator intended to generate a gas hydrate; and a flow regulating valve provided to a pipe through which a part of the gas hydrate slurry generated by the second generator is returned to the second mixer; and partition walls provided in each of end plates placed respectively in the front and rear ends of each of the first and second generators, the partition walls each causing the slurry to turn around.

* * * * *